US011297950B2

(12) United States Patent
Sabbagh

(10) Patent No.: US 11,297,950 B2
(45) Date of Patent: Apr. 12, 2022

(54) HANGING CHAIR WITH COLLAPSIBLE SPREADER BAR

(71) Applicant: Snow Joe, LLC, Hoboken, NJ (US)

(72) Inventor: Victor Sabbagh, Brooklyn, NY (US)

(73) Assignee: Snow Joe, LLC, Hoboken, NJ (US)

( * ) Notice: Subject to any disclaimer, the term of this patent is extended or adjusted under 35 U.S.C. 154(b) by 0 days.

(21) Appl. No.: 16/723,111

(22) Filed: Dec. 20, 2019

(65) Prior Publication Data

US 2020/0121085 A1 Apr. 23, 2020

Related U.S. Application Data

(62) Division of application No. 15/833,103, filed on Dec. 6, 2017, now Pat. No. 10,575,647.

(51) Int. Cl.

| | |
|---|---|
| ***A47C 5/02*** | (2006.01) |
| ***A47C 3/025*** | (2006.01) |
| ***A47C 3/023*** | (2006.01) |
| *A47C 5/10* | (2006.01) |

(52) U.S. Cl.

CPC ..... *A47C 5/02* (2013.01); *A47C 3/023* (2013.01); *A47C 3/0255* (2013.01); *A47C 5/10* (2013.01)

(58) Field of Classification Search

CPC ..... A47C 5/02; A47C 3/023; A47C 3/0255; A47C 5/10

See application file for complete search history.

(56) References Cited

U.S. PATENT DOCUMENTS

| | | | | |
|---|---|---|---|---|
| 700,978 | A * | 5/1902 | Palmer | A45F 3/22 5/122 |
| 3,526,909 | A * | 9/1970 | Kotler | A45F 3/22 5/123 |
| 4,002,368 | A | 1/1977 | Ortize | |
| 4,188,063 | A | 2/1980 | Dusart | |
| 4,784,436 | A | 11/1988 | Sutherland | |
| 5,035,012 | A * | 7/1991 | Westrich | A45F 3/24 5/139 |
| 5,097,545 | A * | 3/1992 | Hooi | A47D 9/02 297/274 |
| 5,673,444 | A | 10/1997 | Middendorf | |
| 5,944,381 | A | 8/1999 | Nguyen | |
| 5,971,480 | A | 10/1999 | Maschke | |
| 6,364,412 | B1 * | 4/2002 | Crawford | A47C 3/0255 297/232 |
| 7,073,857 | B1 | 7/2006 | Bailey | |
| 7,240,961 | B2 * | 7/2007 | Grace | A47C 4/286 297/16.2 |
| 7,753,610 | B2 * | 7/2010 | Gehrke | A61G 7/0755 403/109.3 |
| 7,870,933 | B2 * | 1/2011 | McInnes | A45F 3/24 182/128 |
| 8,414,072 | B2 | 4/2013 | Phillips | |
| 8,491,053 | B2 | 7/2013 | Stringer | |
| 9,468,284 | B2 | 10/2016 | Wehner | |

(Continued)

*Primary Examiner* — Philip F Gabler

(74) *Attorney, Agent, or Firm* — Seyfarth Shaw LLP; Brian Michaelis

(57) ABSTRACT

A hanging chair includes a collapsible spreader bar that reduces the size of the product when in a disassembled configuration. The hanging chair includes a flexible seating portion having first and second side edges. A plurality of ropes connect the first and second side edges of the flexible seating portion to the collapsible spreader bar.

9 Claims, 8 Drawing Sheets

(56) References Cited

U.S. PATENT DOCUMENTS

| | | | | |
|---|---|---|---|---|
| 10,575,647 | B2 * | 3/2020 | Sabbagh | A47C 3/0255 |
| 11,000,111 | B2 * | 5/2021 | Sabbagh | A45F 3/24 |
| 2007/0051858 | A1 | 3/2007 | Bailey | |
| 2014/0310872 | A1 | 10/2014 | Rozman | |
| 2016/0052560 | A1 * | 2/2016 | Peterson | B62J 23/00 280/154 |
| 2016/0120317 | A1 | 5/2016 | Zhao | |

* cited by examiner

HANGING CHAIR WITH COLLAPSIBLE SPREADER BAR

CROSS-REFERENCE TO RELATED APPLICATION

The present application is a divisional of U.S. patent application Ser. No. 15/833,103, filed Dec. 6, 2017, the entire contents of which are incorporated by reference herein.

FIELD

The present invention is generally related to an improved hanging chair and, more particularly, a hanging chair that includes a collapsible spreader bar.

BACKGROUND

Hanging chairs, also known as hammock chairs, are commonly used for leisure and relaxation. Such chairs are typically suspended from a tree, post or other structure capable of supporting a person and generally include a cloth or fabric seating surface. Often, the seating surface is suspended from a spreader bar using, for example, ropes or cables.

Spreader bars known in the art are typically several feet long and often manufactured out of hardwoods or other rigid materials. The length of the spreader bar creates several problems for manufacturers, distributors, retailers and end-users. For example, when shipping items, it is desirable to minimize their overall size. However, the length of the spreader bar in a conventional hanging chair necessitates a large, cumbersome, package that is costly to ship. Conventional hanging chairs, likewise, require a large amount of shelf space in retail stores and are difficult for end-users to store when not in use.

What is needed is an improved hanging chair, which can meet the packaging and storage needs of manufacturers, distributors, retailers and end-users.

SUMMARY

The present invention meets the needs described above by providing an improved hanging chair that includes a collapsible spreader bar.

In accordance with an embodiment of the present invention, a hanging chair, comprises a flexible seating portion having first and second side edges, a collapsible spreader bar, and a plurality of ropes for connecting the first and second side edges of the flexible seating portion to the collapsible spreader bar.

In embodiments, the hanging chair further comprising an upper chair support comprising a loop for hanging the collapsible spreader bar from a support structure and two end loops for connecting to the collapsible spreader bar. In embodiments, the collapsible spreader bar comprises a first segment and a second segment. In embodiments, each of the first and second segments has a first end and a second end, and each of the first ends are configured to releasably connect with one another.

In embodiments, each of the second ends facilitates connection with the plurality of ropes for connecting the flexible seating portion to the collapsible spreader bar. In embodiments, the first end of the first segment includes a spring button that is configured to engage with an opening in the first end of the second segment.

In accordance with an embodiment of the present invention, a hanging chair, comprises a flexible seating portion having first and second side edges, a collapsible spreader bar, a plurality of ropes for connecting the first and second side edges of the flexible seating portion to the collapsible spreader bar, and an upper chair support comprising a loop for hanging the collapsible spreader bar from a support structure and two end loops for connecting to the collapsible spreader bar.

In embodiments, the collapsible spreader bar comprises a first segment and a second segment. In embodiments, each of the first and second segments comprises a first end and a second end, each of the first ends are configured to releasably connect with one another. In embodiments, each of the second ends are adapted to facilitate connection with the plurality of ropes for connecting the flexible seating portion to the collapsible spreader bar. In embodiments, the first end of the first segment further comprises a spring button and the first end of the second segment further comprises an opening for receiving the spring button.

In accordance with an embodiment of the present invention, a collapsible spreader bar, comprises a first segment and a second segment, each of the first and second segments having a first end and a second end, wherein each of the first ends are configured to releasably connect with one another and wherein each of the second ends are adapted to receive one or more ropes to facilitate the connection and suspension of a hanging chair.

In embodiments, each of the second ends includes one or more grooves to facilitate the connection and suspension of a hanging chair. In embodiments, the first end of the first segment is configured to fit within the first end of the second segment. In embodiments, the first end of the first segment further comprises a spring button and the first end of the second segment further comprises an opening for receiving the spring button. In embodiments, the first end of the first segment comprises a male threaded portion and the first end of the second segment comprises a female threaded portion. In embodiments, the overall length of the collapsible spreader bar is between 28 to 48 inches.

BRIEF DESCRIPTION OF THE DRAWINGS

Exemplary embodiments of the present invention will be described with references to the accompanying figures, wherein.

DETAILED DESCRIPTION

The present invention is generally related to an improved hanging chair, such as a hanging chair with a collapsible spreader bar. Specifically, the improved hanging chair includes a spreader bar that may be readily disassembled, folded, or otherwise collapsed for shipping or storage.

Figure 1:
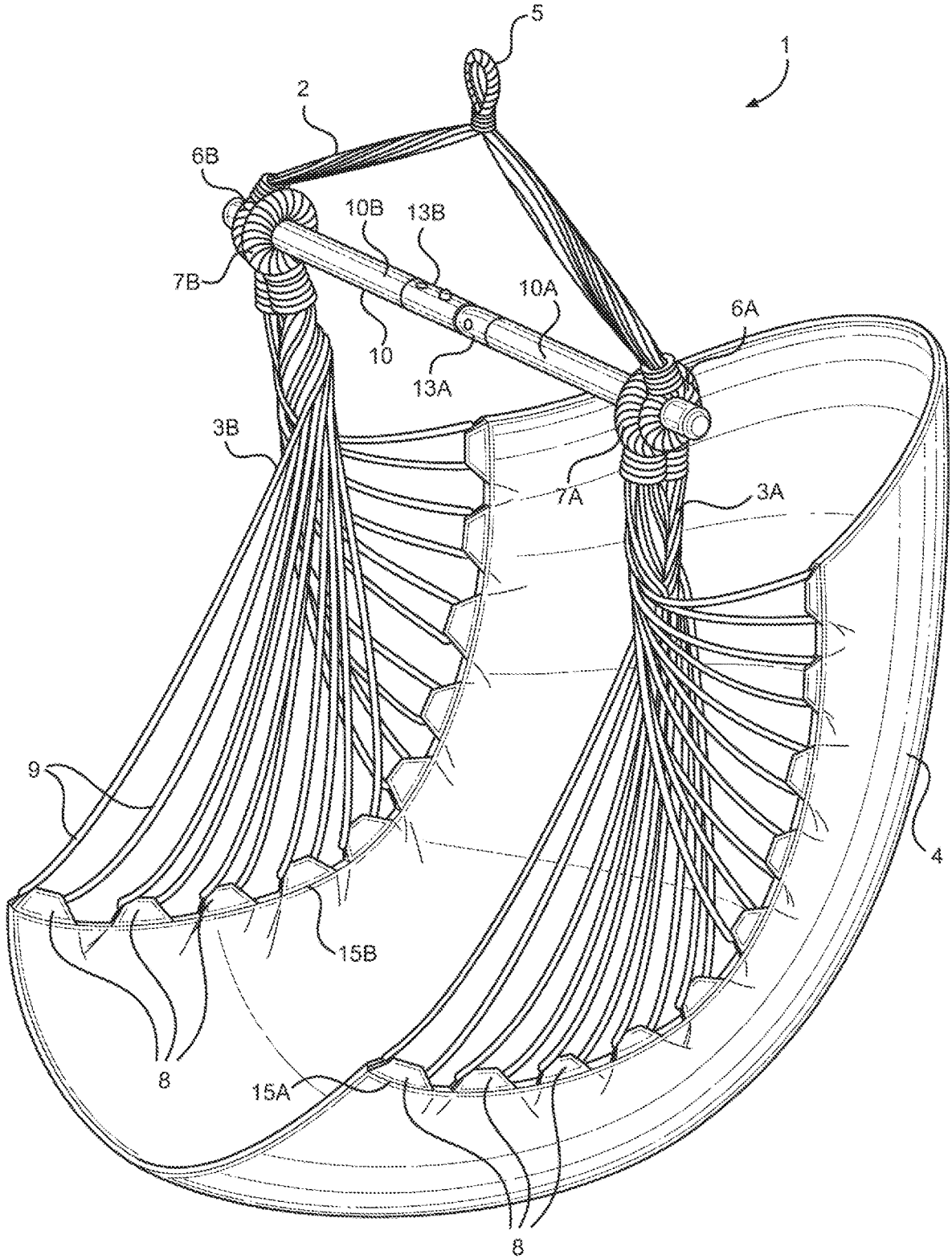
FIG. 1 is a perspective view of the hanging chair according to an embodiment of the present invention.
Figure 2:
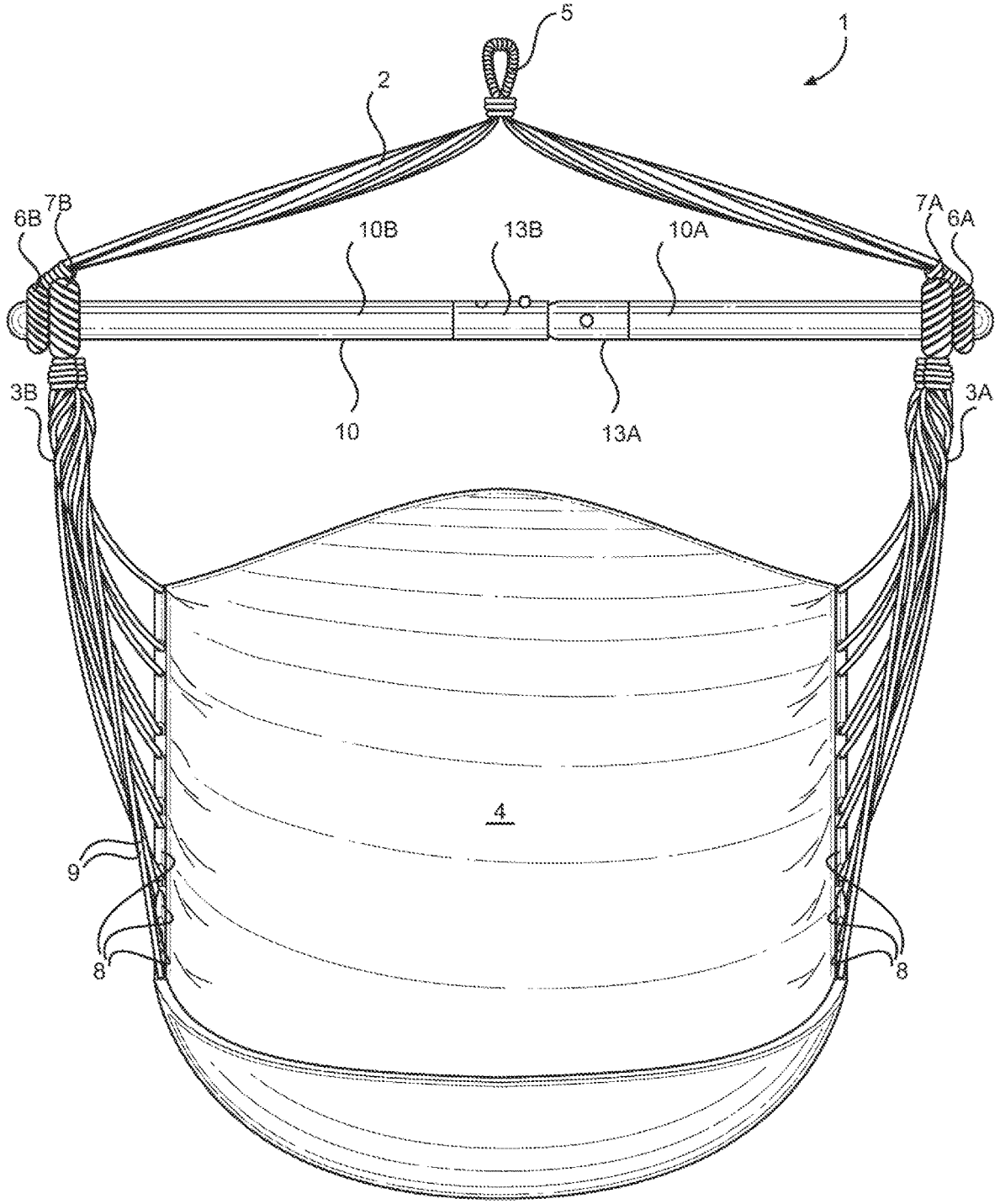
FIG. 2 is a front view of the hanging chair of FIG. 1.
Figure 3:
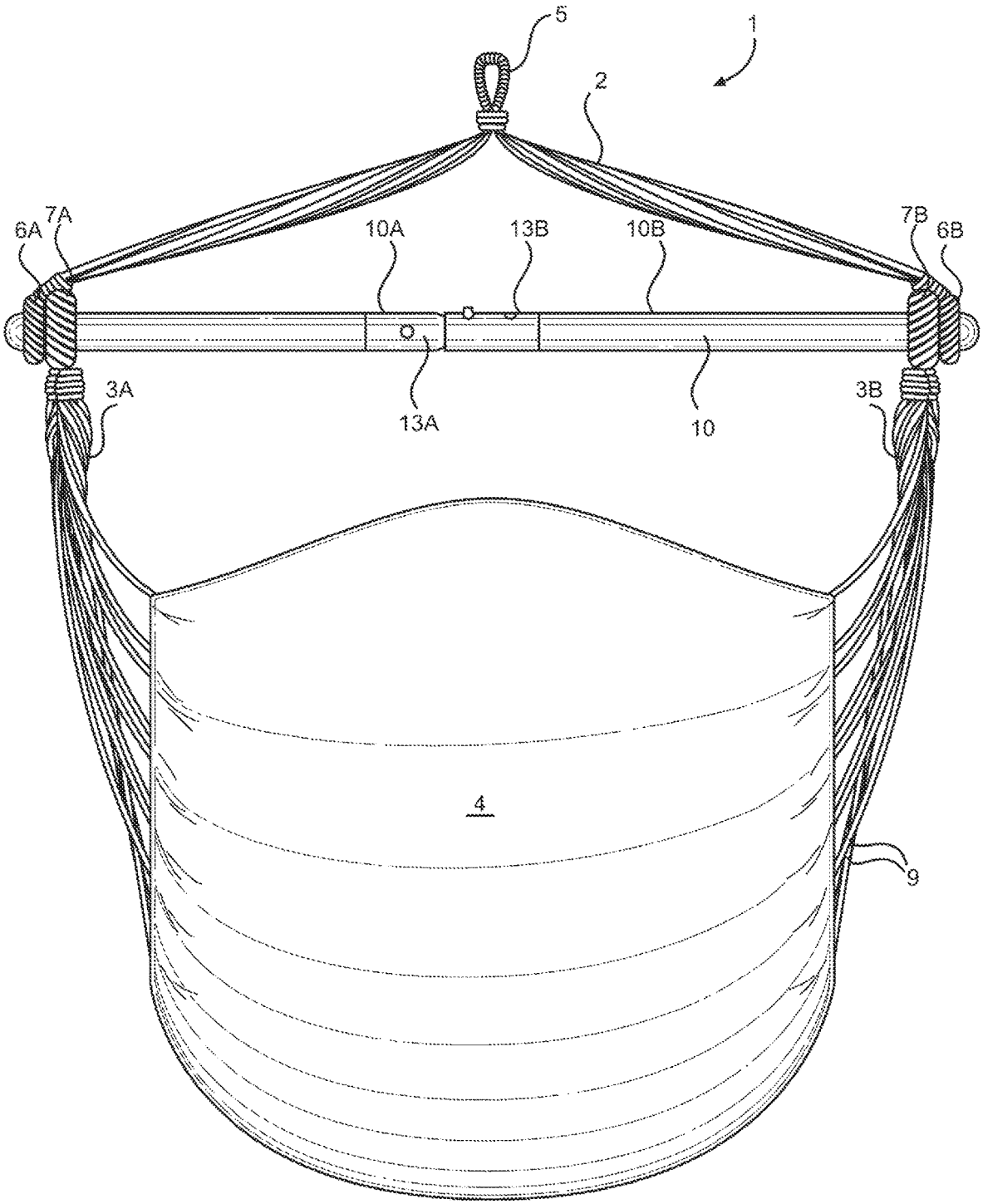
FIG. 3 is a rear view of the hanging chair of FIG. 1.
Figure 4:
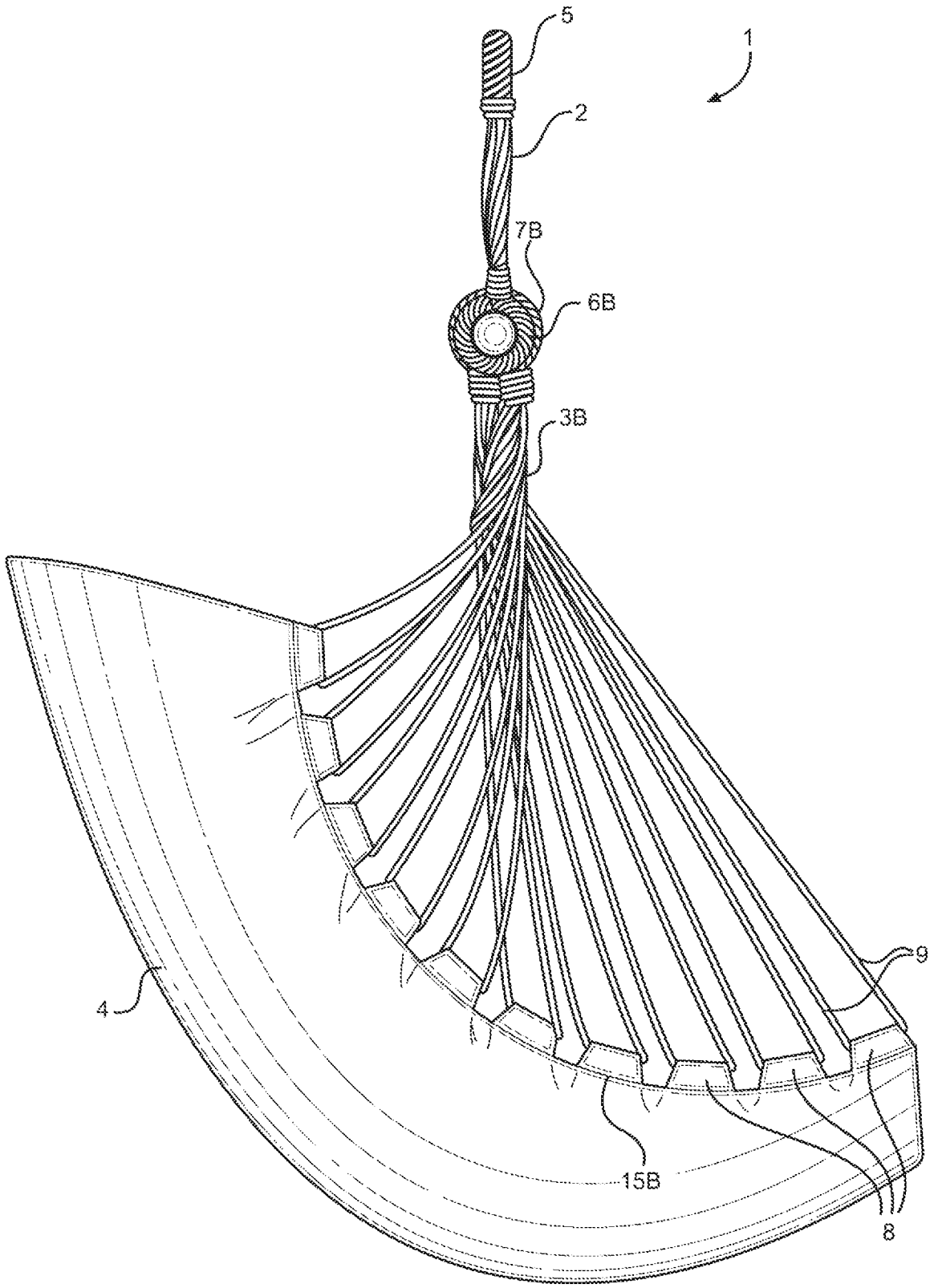
FIG. 4 is a left side view of the hanging chair of FIG. 1.
Figure 5:
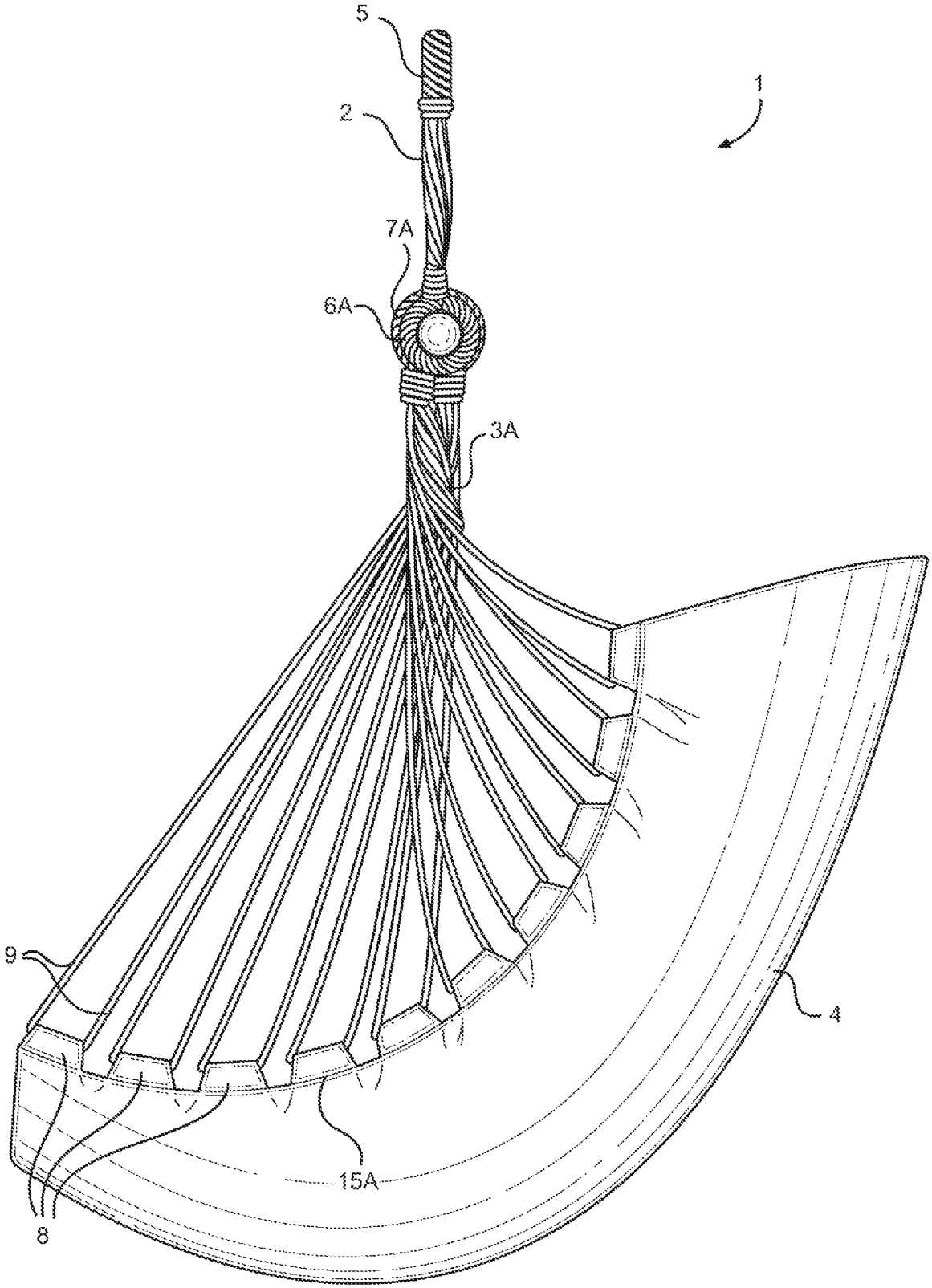
FIG. 5 is a right side view of the hanging chair of FIG. 1.
Figure 6:
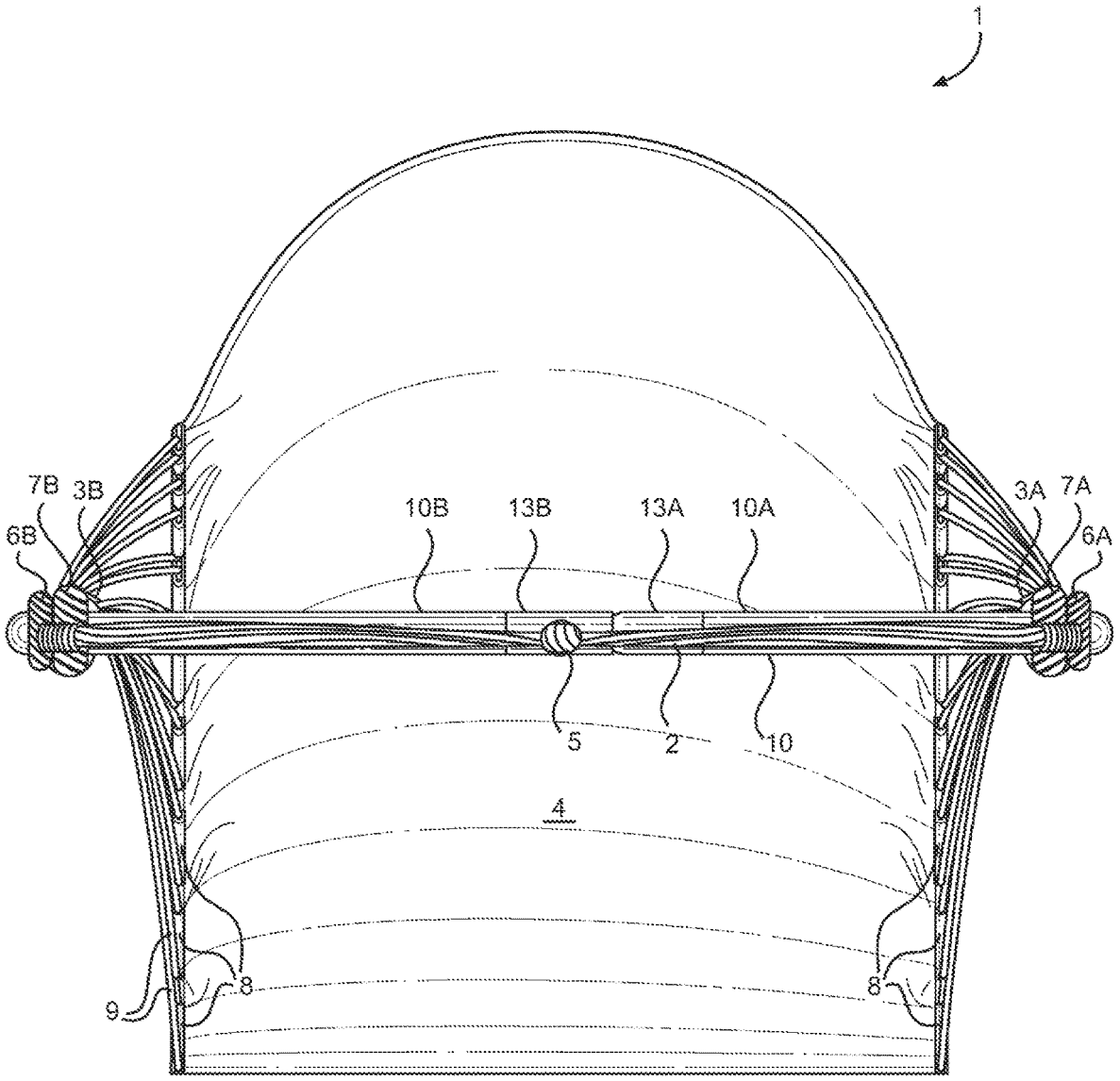
FIG. 6 is a top view of the hanging chair of FIG. 1.
Figure 7:
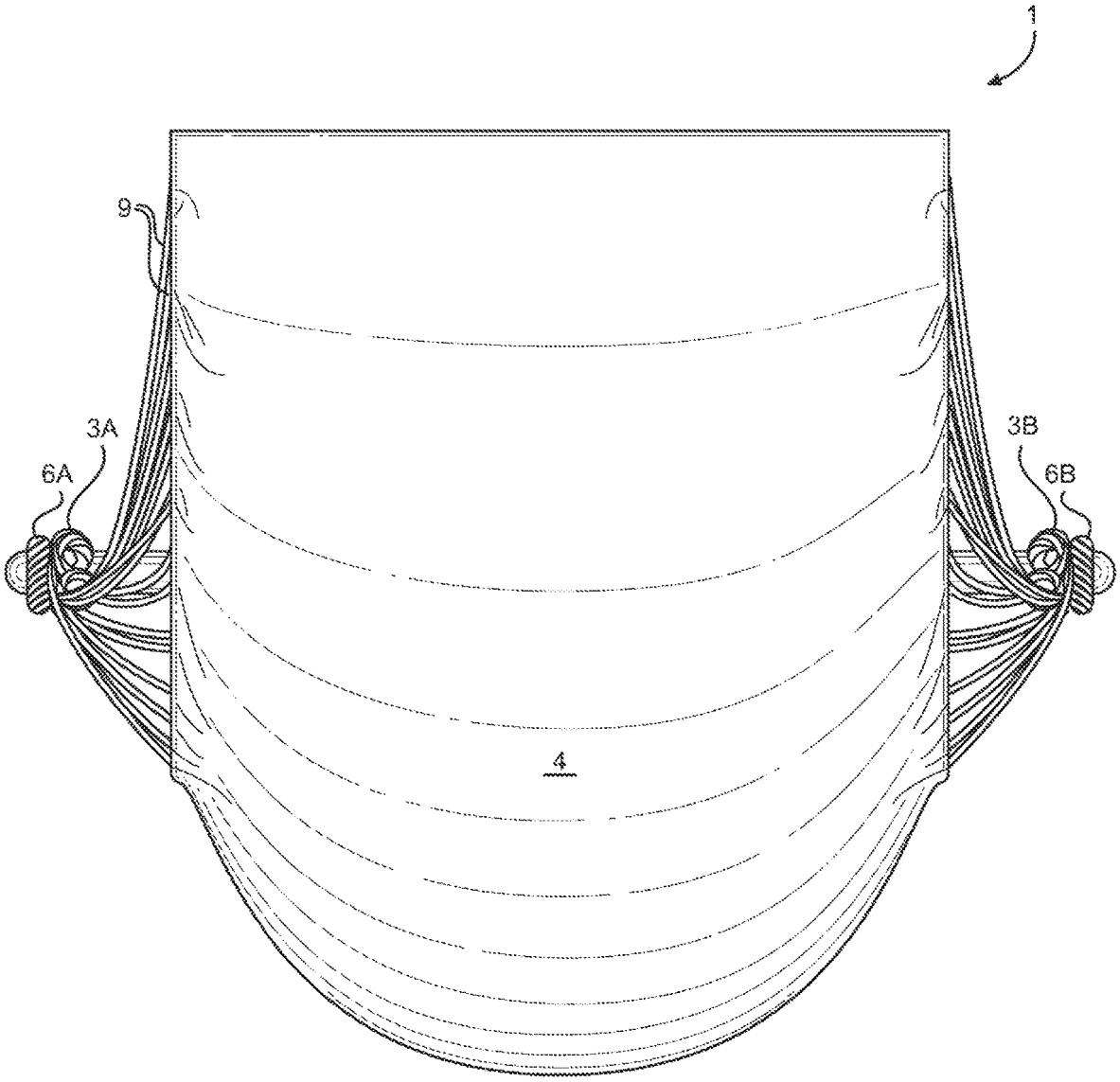
FIG. 7 is a bottom view of the hanging chair of FIG. 1.

Referring to FIG. 1, a hanging chair 1 in accordance with exemplary embodiments of the present invention has a seating portion 4 that is configured to support the body of a person in a seated position. Seating portion 4 may be formed of any flexible material, such as woven and non-woven fabrics, including cotton, polyester and canvas. Alternatively, or in addition, the seating portion 4 may comprise a PVC or a vinyl layer. Seating portion 4 has first and second side edges 15A, 15B that include a plurality of loops 8. Loops 8 may be formed by sewing, gluing heat bonding, or other known methods, depending on the type of material selected for seating portion 4. In embodiments of the invention, loops 8 are integrally formed with seating portion 4.

Loops 8 are used to connect the seating portion 4 to collapsible spreader bar 10. Specifically, respective ropes 9 are threaded through respective loops 8 and are connected to spreader bar 10. Ropes 9 may be formed of any suitable natural or synthetic material, including cotton, polypropylene, nylon, polyesters, polyethylene, Aramids and acrylics. Ropes 9 may also be formed of wire, cords, or any other material that can provide sufficient tensile strength to support a person. In one embodiment, terminal ends of respective ropes 9 are arranged into bundles (e.g. bundles 3A, 3B) and include end loops 7A, 7B. End loops 7A, 7B are sized and shaped to fit snugly around the shaft of collapsible spreader bar 10.

In one embodiment, hanging chair 1 includes upper chair support 2, which may be used to suspend the hanging chair from a suitable support structure, such as a tree, post, or specially constructed stand. Upper chair support 2 is an elongated member having a first end, a second end, and a midpoint therebetween. The upper chair support 2 is positioned above the spreader bar 10 and is configured to support the spreader bar 10 between its first and second ends. In embodiments of the invention, upper chair support 2 is formed of one or more ropes, such as those discussed above. It will be understood that upper chair support 2 may include a loop 5, or similar ring at its midpoint, for suspending the hanging chair 1 from a hook or similar structure. Loop 5 may be reinforced with a metal or rigid plastic insert to avoid abrasion. In one embodiment, upper chair support 2 may include end loops 6A, 6B that are configured to attach to collapsible spreader bar 10.

Additional views of the hanging chair of the present invention are shown in FIGS. 2-7.

Figure 8:
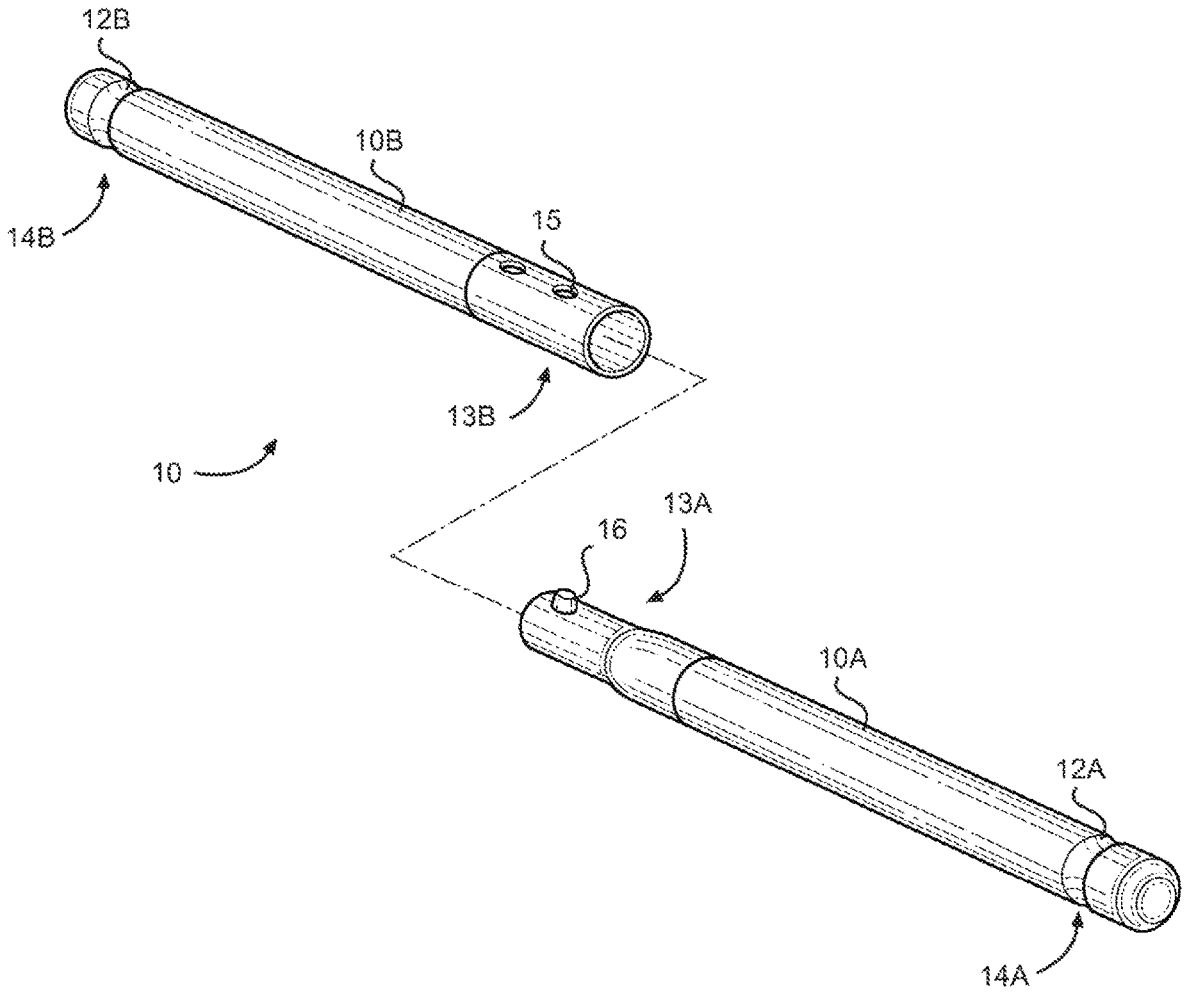
FIG. 8 is an exploded view of a collapsible spreader bar according to an embodiment of the invention.

As described above, the hanging chair 1 of the present invention includes a collapsible spreader bar 10. An exemplary exploded view of the spreader bar 10 of the present invention is shown in FIG. 8. The bar 10 may have an overall length between 28 to 48 inches when assembled. It will be understood that bar 10 may be manufactured out of any suitable rigid materials such as wood, (e.g., oak, cherry, teak), synthetic materials (e.g., plastic, fiberglass, steel, aluminum), or combinations of such materials.

In the exemplary embodiment of FIG. 8, collapsible spreader bar 10 is shown having a first segment 10A and a second segment 10B. First and second segments 10A, 10B are adapted to releasably interconnect. In this regard, each of the first and second segments 10A, 10B have first end portions 13A, 13B and second end portions 14A, 14B. In the exemplary embodiment, first end portion 13A is adapted to fit within first end portion 13B. Specifically, first end portion 13A comprises a reduced circumference, as compared to the remainder to first segment 10A. End portion 13B comprises an opening, or hollow chamber, that is sized and shaped to receive first end portion 13A. When mated together, first and second segments 10A, 10B form a substantially rigid bar. In the exemplary embodiment, the first end portions 13A, 13B are comprised of metal (e.g., steel, aluminum) while the remainder of the bar is comprised of wood. The second end portions 14A, 14B include one or more grooves 12A, 12B to facilitate the connection and suspension of a hanging chair.

As shown in the exemplary embodiment, first end portion 13A includes a spring button 16 (also known as a spring clip) that is configured to releasably engage with opening 15 in end portion 13B. In embodiments of the invention, spring button 16 is a pin or similar cylindrical member having a first end housed in the inner cavity of first end portion 13A and a second end (shown) extending from an aperture in first end portion 13A. A spring disposed below spring button 16 biases the spring button outwardly (e.g. in the direction away from longitudinal axis of segment 10A).

Other mechanisms for releasably connecting first and second segments 10A, 10B will be apparent to those of skill in the art. For example, end portions 13A, 13B may interconnect by an interference fit (also known as a press fit or friction fit) or using screws, bolts, clips other types of fasteners. In one embodiment, end portions 13A, 13B may comprise a male threaded portion a female threaded portion, respectively. In one embodiment, end portions 13A, 13B may be interconnected using a coupling that, for example, bolts to end portions 13A, 13B. In another embodiment, first and second segments 10A, 10B may be connected with a hinge that permits folding of collapsible bar 10, e.g., in half. It should be understood that collapsible bar 10 may have more than two segments. For example, the collapsible bar 10 may comprise three or more segments, further reducing the overall length of the hanging chair package.

In an exemplary method of assembling the hanging chair 1, a user forms a complete spreader bar 10 by connecting segment 10A to segment 10B. For example, the user presses down on spring button 16 to overcome the spring bias and lower the button 16. Thereafter, the user inserts first end portion 13A of segment 10A into the cavity formed by first end segment 13B of segment 10B. The user then aligns spring button 16 with opening 15 such that spring button 16 is urged by the spring to insert into opening 15. Once so assembled, the loop 5 of upper chair support 2 is mounted on a hook or similar structure.

While particular embodiments of the present invention have been shown and described in detail, it would be obvious to those skilled in the art that various modifications and improvements thereon may be made without departing from the spirit and scope of the invention. It is therefore intended to cover in the appended claims all such modifications and improvements that are within the scope of this invention.

What is claimed is:

1. A collapsible spreader bar, comprising:

a first separable segment having a first end and a second end and a first groove proximate to the second end of the first separable segment and a second separable segment having a first end and a second end and a second groove proximate to the second end of the second separable segment;

the first separable segment directly and releasably connecting to the second separable segment to form the collapsible spreader bar;

the first separable segment configured to releasably disconnect from the second separable segment to configure a separated first separable segment and separated second separable segment;

the first end of the first separable segment being configured to fit within the first end of the second separable segment to form the collapsible spreader bar;

each of the second ends adapted to receive one or more ropes to facilitate connection and suspension of a hanging chair; and a chair support configured to support the collapsible spreader bar formed by connecting the first separable segment and second separable segment.

2. The collapsible spreader bar of claim 1, wherein the first end of the first segment further comprises a spring button and the first end of the second segment further comprises an opening for receiving the spring button.

3. The collapsible spreader bar of claim 1 wherein the first end of the first segment comprises a male threaded portion and the first end of the second segment comprises a female threaded portion.

4. The collapsible spreader bar of claim 1, wherein an overall length of the bar is between 28 to 48 inches.

5. The collapsible spreader bar of claim 1, wherein the first and second grooves proximate to the second ends facilitate the connection and suspension of the hanging chair.

6. The collapsible spreader bar of claim 5, wherein the first and second grooves are dimensioned to receive a respective end loop of an upper chair support adapted to hang the collapsible spreader bar and the hanging chair.

7. The collapsible spreader bar of claim 5, wherein the first and second grooves are dimensioned to receive a respective end loop connected to the hanging chair by a respective twist bundle of a plurality of ropes.

8. The collapsible spreader bar of claim 1, wherein the first and second segments are comprised of wood.

9. The collapsible spreader bar of claim 1, wherein the first ends of the first and second segments comprise a metal.

* * * * *